US010900282B2

(12) United States Patent
Ford

(10) Patent No.: US 10,900,282 B2
(45) Date of Patent: Jan. 26, 2021

(54) SAFETY LADDER

(71) Applicant: James B. Ford, Dublin, OH (US)

(72) Inventor: James B. Ford, Dublin, OH (US)

( * ) Notice: Subject to any disclaimer, the term of this patent is extended or adjusted under 35 U.S.C. 154(b) by 0 days.

(21) Appl. No.: 15/851,659

(22) Filed: Dec. 21, 2017

(65) Prior Publication Data

US 2018/0187486 A1 Jul. 5, 2018

Related U.S. Application Data

(60) Provisional application No. 62/437,175, filed on Dec. 21, 2016.

(51) Int. Cl.

| | |
|---|---|
| ***E06C 1/34*** | (2006.01) |
| ***E06C 7/06*** | (2006.01) |
| ***E06C 5/32*** | (2006.01) |
| ***E06C 7/48*** | (2006.01) |
| ***E06C 1/32*** | (2006.01) |
| ***E06C 7/18*** | (2006.01) |

(52) U.S. Cl.

CPC ..... *E06C 1/345* (2013.01); *E06C 1/32* (2013.01); *E06C 5/32* (2013.01); *E06C 7/06* (2013.01); *E06C 7/188* (2013.01); *E06C 7/486* (2013.01)

(58) Field of Classification Search

CPC ... E06C 1/34; E06C 1/345; E06C 1/36; E06C 7/188; E06C 7/48; E06C 7/486; E06C 7/488

See application file for complete search history.

(56) References Cited

U.S. PATENT DOCUMENTS

| | | | | | |
|---|---|---|---|---|---|
| 836,785 | A * | 11/1906 | Shumaker | E06C 1/345 | 182/103 |
| 1,502,490 | A * | 7/1924 | Tack | E06C 7/48 | 182/214 |
| 2,432,189 | A * | 12/1947 | Bucher | E06C 7/48 | 182/214 |
| 2,485,413 | A * | 10/1949 | Ross | B60R 3/007 | 182/214 |
| 2,629,532 | A * | 2/1953 | Tupper | E06C 7/183 | 182/163 |
| 2,680,554 | A * | 6/1954 | Dakin | E06C 7/48 | 182/214 |
| 2,781,158 | A * | 2/1957 | Raitt | E06C 1/32 | 182/163 |
| 3,554,318 | A * | 1/1971 | Knight | E06C 1/39 | 182/24 |
| 3,734,236 | A * | 5/1973 | Houtler | E06C 7/48 | 182/121 |
| 4,102,433 | A * | 7/1978 | Van Valkenburgh | E06C 1/12 | 182/164 |

(Continued)

*Primary Examiner* — Katherine W Mitchell
*Assistant Examiner* — Shiref M Mekhaeil
(74) *Attorney, Agent, or Firm* — Miracle IP; Bryce D. Miracle

(57) ABSTRACT

A safety ladder for accessing the rooftop of a building structure is disclosed. In a version, the safety ladder comprises a first and second side rail extending between a lower free end and an upper free end; a plurality of horizontal rungs vertically disposed between the side rails; and a hinged roof portion operably positioned between the first and second side rails near the upper free end terminating at a top end, wherein the hinged roof portion rotates about a hinge axis between a default position and a forward rooftop position.

4 Claims, 16 Drawing Sheets

(56) References Cited

U.S. PATENT DOCUMENTS 4,185,360 A * 1/1980 Prete, Jr. ..... B25B 25/00 24/68 CD
4,331,217 A * 5/1982 Stecklow ..... E06C 7/48 182/107
4,371,055 A * 2/1983 Ashton ..... E06C 1/12 156/166
4,376,470 A * 3/1983 Ashton ..... E06C 1/22 182/207
4,408,680 A * 10/1983 Ross ..... E06C 7/42 182/108
4,723,632 A * 2/1988 Gedgoudas ..... E06C 7/48 182/206
4,924,971 A * 5/1990 Rice ..... E06C 1/34 182/107
5,078,231 A * 1/1992 Davis ..... E06C 7/42 182/107
5,165,501 A * 11/1992 Donahey ..... E06C 7/42 182/107
5,279,387 A * 1/1994 Swiderski ..... E06C 1/32 182/108
5,855,252 A * 1/1999 Vrolyks ..... E06C 7/48 182/107
5,924,521 A * 7/1999 Crockett ..... B63B 27/14 182/106
5,954,157 A * 9/1999 Grimes ..... E06C 1/12 16/329
6,009,974 A * 1/2000 Jones ..... E06C 7/48 182/107
6,152,261 A * 11/2000 Hoey ..... E06C 7/48 182/107
6,220,389 B1 * 4/2001 Krause ..... E06C 1/12 182/163
6,805,221 B1 * 10/2004 Lee ..... E06C 1/34 182/107
6,913,114 B1 * 7/2005 Blehm ..... E04D 15/00 182/104
8,651,259 B1 * 2/2014 Blehm ..... E06C 7/50 193/41
8,752,672 B2 * 6/2014 Turner ..... E06C 7/48 182/214
8,844,675 B2 * 9/2014 Lampe ..... E06C 7/182 182/107
9,404,305 B1 * 8/2016 Messick ..... E06C 1/393
9,500,029 B1 * 11/2016 Mullins ..... E06C 5/24
9,745,026 B1 * 8/2017 Cummings ..... B63B 27/146
9,951,558 B2 * 4/2018 Maragliano ..... E06C 7/505
2002/0046543 A1 * 4/2002 Neuleib ..... E06C 1/345 52/749.12
2003/0188923 A1 * 10/2003 Moss ..... E06C 1/32 182/23
2004/0089501 A1 * 5/2004 Hockensmith ..... E06C 7/48 182/107
2004/0140156 A1 * 7/2004 Moss ..... E06C 7/06 182/180.2
2005/0139425 A1 * 6/2005 Thomas ..... E06C 1/34 182/214
2006/0054399 A1 * 3/2006 Dudschus ..... E06C 1/36 182/214
2006/0289233 A1 * 12/2006 Flaherty ..... A62B 35/0068 182/45
2009/0266646 A1 * 10/2009 Hamann ..... E06C 7/188 182/107
2012/0080263 A1 * 4/2012 Lee ..... E06C 1/345 182/8
2012/0175188 A1 * 7/2012 Xu ..... E06C 7/488 182/107
2014/0041965 A1 * 2/2014 Hess ..... E06C 7/188 182/107
2014/0318894 A1 * 10/2014 Chow ..... E06C 7/48 182/214

* cited by examiner

Detail A.

SAFETY LADDER

RELATED U.S. APPLICATIONS

This application is based upon and claims the priority filing date of the previously filed, U.S. Provisional patent application entitled "Safety Ladder System" filed Dec. 21, 2016, Ser. No. 62/437,175, the entire disclosure of which is hereby incorporated herein by reference.

FIELD OF INVENTION

The present invention relates to ladders, in particular, to an improved ladder system which provides superior stability when ascending and traversing a rooftop surface.

BACKGROUND

A ladder is a tool which is made for people to climb up or down to reach another level. Ladders typically have two vertical support rails that run parallel along the length of the ladder. Between these rails are a plurality of horizontal rungs. The rungs are what the user puts their foot on—using their hands to hold on to the rungs above, or to the supports at the side.

There are many different types of ladders such as a unitary length ladder adapted for leaning against a wall or rooftop eve, a step ladder or even an extension ladder which contains slidable segments in order to extend the length thereof.

Step ladders are useful in the home or the garden to reach various items. They have two parts which are joined together by a hinge, so that they are shaped like an upside down V adjacent to the ground.

Currently in the art, ladders are often utilized in order to gain access to a rooftop of a building structure, such as a house or commercial structure for purposes of inspection. Many ladders have been developed for this purpose and have standard safety features. However, many of these ladders lack lateral stability, particularly while stepping on and off, to and from the rooftop surface near the top of the ladder. Many accidents have occurred due to a lack of safety features which provide stability to current safety ladders.

For the foregoing reasons, there is a need for an improved ladder design which can be utilized to improve stability and maximize safety while attempting to gain access to a rooftop platform.

SUMMARY

In accordance with the invention, a safety ladder system is uniquely constructed to provide superior adaptation and access to a rooftop and support for users. In a version of the invention, the safety ladder system generally comprises: a first and second side rails extending between a lower free end and an upper free end; a plurality of horizontal rungs vertically disposed between the side rails; and a hinged roof portion operably positioned between the first and second side rails near the upper free end terminating at a top end, wherein the hinged roof portion rotates about a hinge axis between a default position and a forward rooftop position.

In certain version, the hinged roof portion at the hinged axis is slidable within a longitudinal path along the first and second side rails, wherein the safety ladder further comprises a locking means operably configured to lock the position of the hinged axis along the path in order to position the hinged roof portion at an angle which is flush with the pitch of the rooftop.

In yet other versions, the top end of the hinged roof portion terminates with a horizontal roof stop, wherein the roof stop provides a catch for objects on the rooftop.

In a version of the application, the horizontal roof stop may have a width greater than the width between the first and second side rails, wherein the roof stop provides an exterior surface that is perpendicular to the surface of the rooftop while the hinged roof portion is engaged in the forward rooftop position, thereby providing a catch for objects on the rooftop.

In certain versions, the ladder may further comprises opposing first and second length adjustable tethers, each tether comprising: a) a line retractor connected to the side rail; b) a line operably connected to the retractor, wherein the line retracts and extends the operably length of the line; c) a means of connecting the line end with a nearby object; and d) a means for locking an operable extended length of line of the length adjustable tether.

In a version, the roof stop may be removably attachable to the hinged roof portion and may further comprise a layer of padding.

In yet another version, the ladder may further provide a step ladder hinge bisecting the length of the ladder into two sections, wherein the safety ladder can be positioned into a step ladder configuration.

In some versions, the first and second side rails near the lower free end diverge apart adapted to be positioned on the ground and the first and second side rails near the upper free end diverge apart terminating at a hand support end.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

Referring now to the figures wherein the showings are for purposes of illustrating a preferred version of the invention only and not for purposes of limiting the same, the present invention is a unique safety ladder which provides safe, secure, and stable passage to and from a rooftop structure.

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other versions that depart from these specific details. In other instances, detailed descriptions of well-known devices, circuits, and methods are omitted so as not to obscure the description of the present invention with unnecessary detail.

Moreover, the description is not to be taken in the limiting sense, but is made merely for the purpose of illustrating the general principles of the invention, since the scope of the invention is best defined by the appended claims. Various inventive features are described below that can each be used independently of one another or in combination with other features.

Unless otherwise defined, all technical terms used herein have the same meaning as commonly understood by one of ordinary skill in the art to which the invention belongs. As used in the specification and the appended claims, the singular forms "a," "an," and "the" include plural references unless the context clearly dictates otherwise. Any reference to "or" herein is intended to encompass "and/or" unless otherwise stated.

Figure 5:
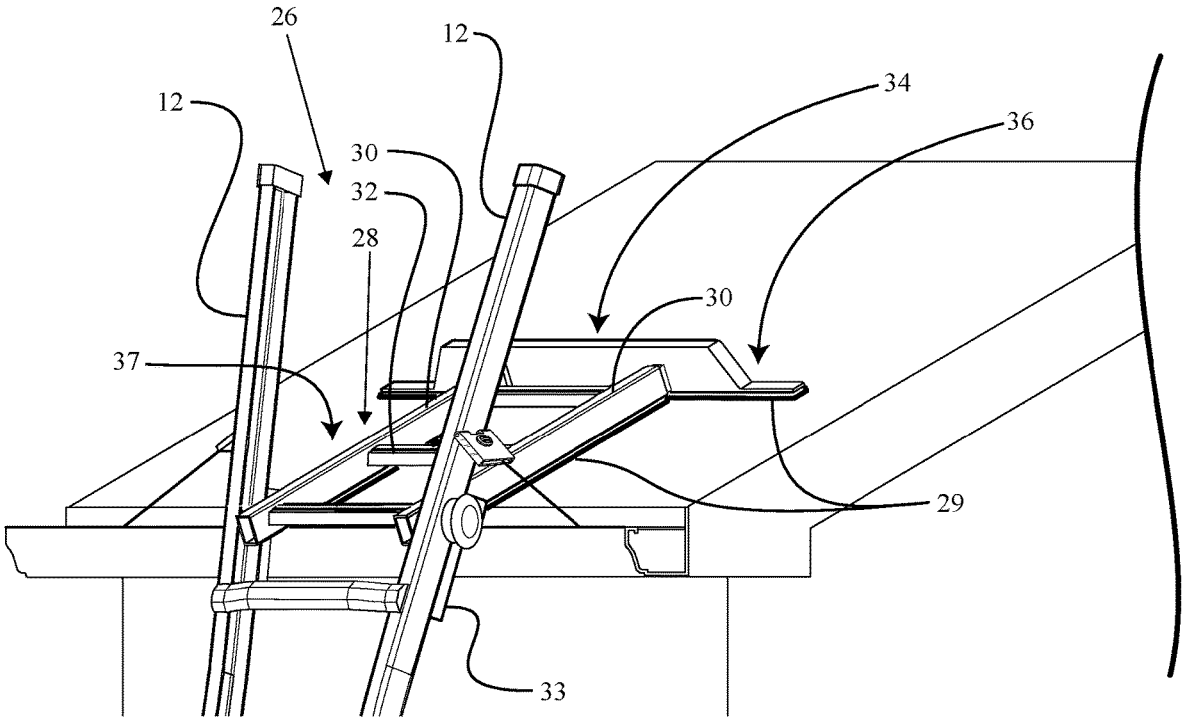
FIG. 5 is an up-close view of the hinged roof portion of the version shown in FIG. 1 shown while in the detached forward position.
Figure 6:
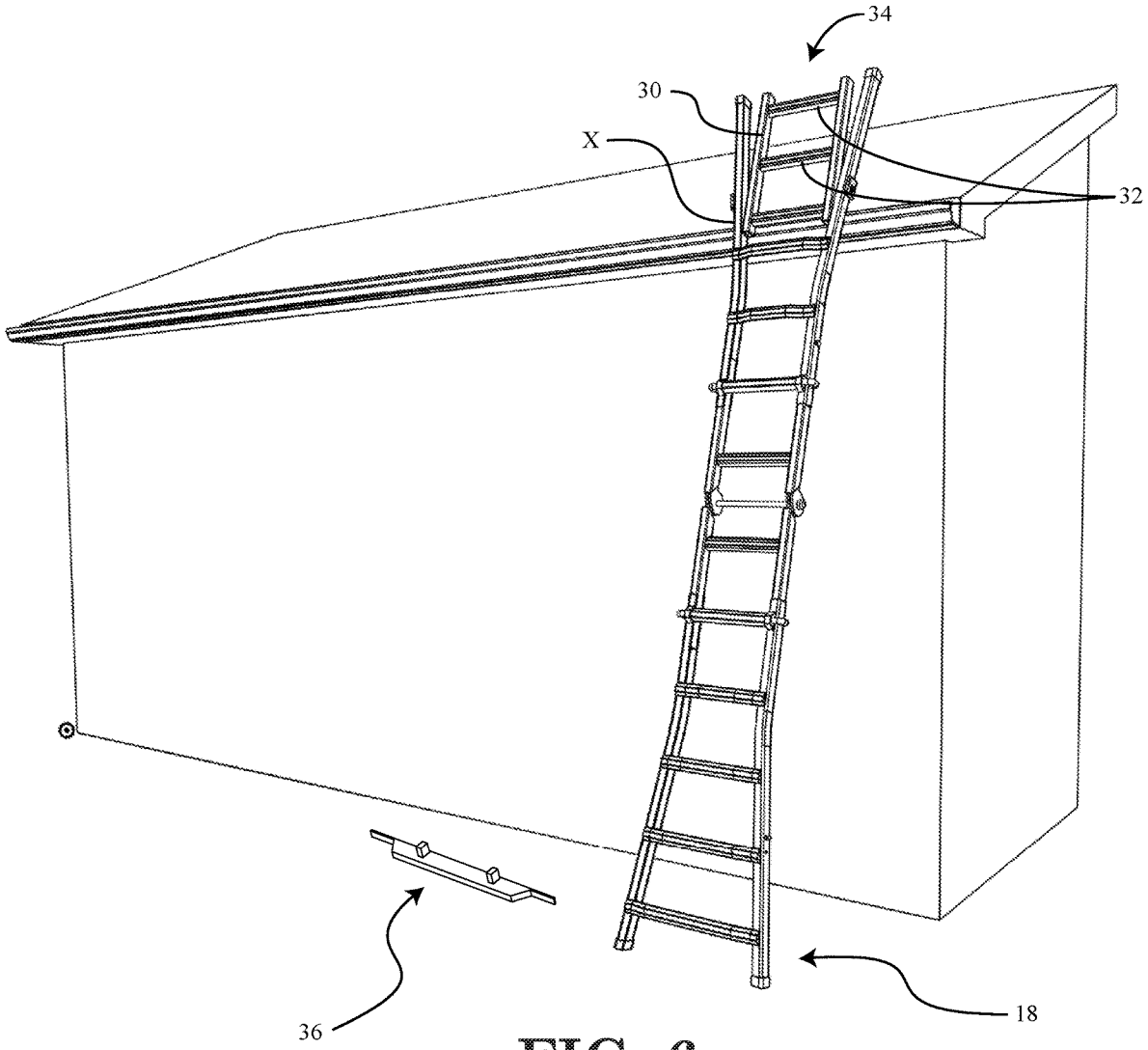
FIG. 6 is a perspective view of the version shown in FIG. 1 wherein the hinged roof portion is in the default position.
Figure 7:
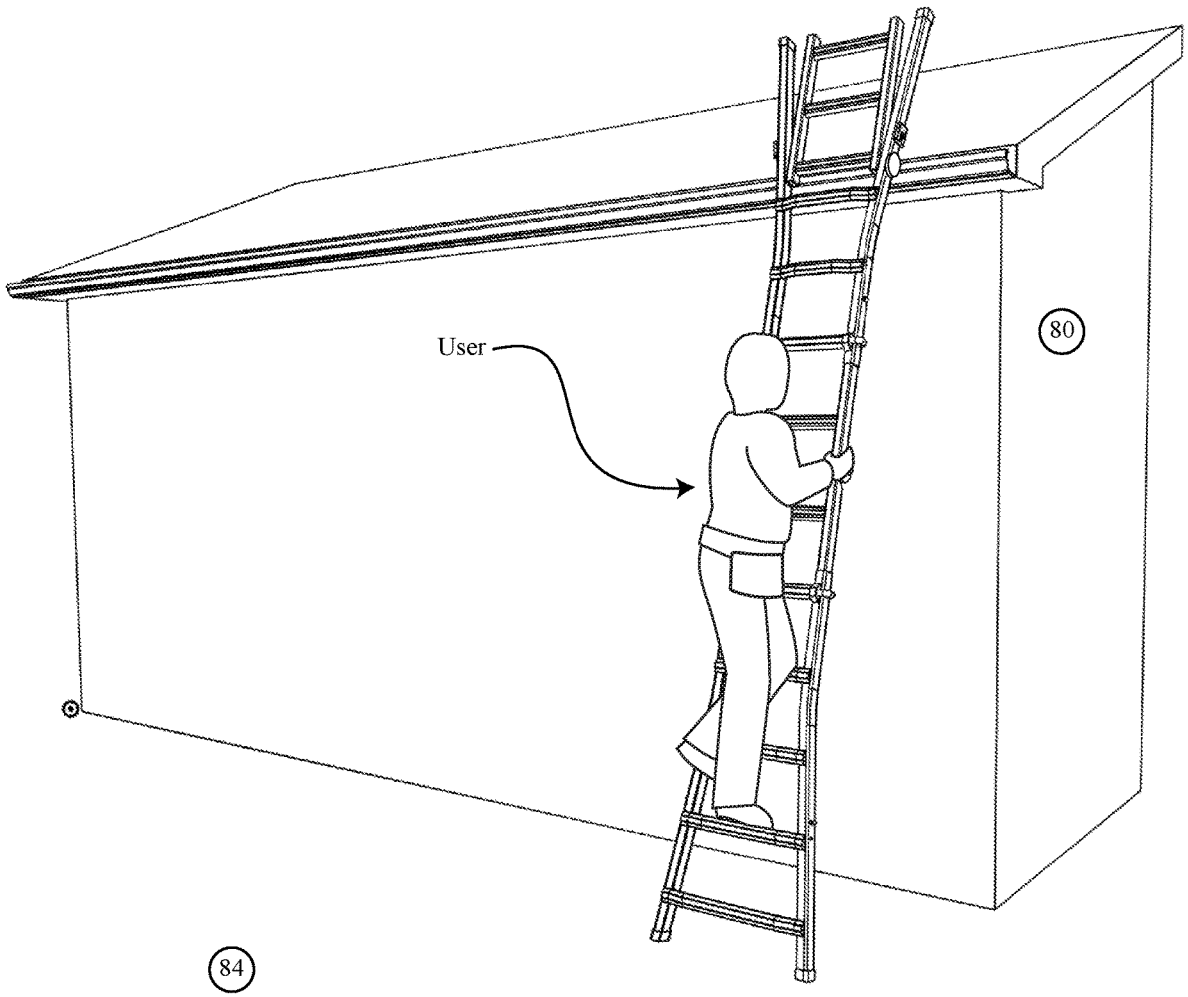
FIG. 7 is an illustrative perspective view of the version shown in FIG. 1.

With reference to the figures, particularly FIG. 1-FIG. 10, a description of a version of the invention will be provided. In particular, FIG. 6 is an illustrative perspective view showing a version of the safety ladder 10 as positioned adjacent to the side of a building structure 80 in order to gain access to the building structures 80 rooftop 82. Generally speaking, the safety ladder 10 generally comprises vertically aligned spaced apart side rails 12. As is well known in the art, the side rails 12 are attached together by a plurality of horizontal rungs 14 vertically disposed therebetween forming steps or a place where the user can ascend utilizing their feet and hands.

In the illustrated version, the safety ladder 10 has an upper free end portion 16 and a lower free end portion 18. The lower free end portion 18 has opposing side rails 12 which diverge towards the ground 84—providing a broader base foot print with the ground 84 while increasing the lateral support of the safety ladder 10.

With reference to the figures, particularly FIG. 2 and FIG. 5, the safety ladder 10 upper free end portion 16 will now be described in detail. In the version, similar to the lower free end portion 18, the upper free end portion 16 side rails 12 diverge upwards freely terminating at upper ends 24 which can be utilized as a form of a handle for assisting ascent to the rooftop 82.

In the illustrated version, the upper free end portion 16 side rails 12 do not contain rungs therebetween providing a gap 26. Between the gap 26 extends upward a hinged roof portion 28 having a top end 34 and a bottom end 37. The hinged roof portion 28 is operably connected to the adjacent upper extending side rails 12 near the bottom end 37 providing a path of motion between an attached, default position and a detached, forward rooftop position rotating about the hinge axis X between each position.

Optionally, in an alternative version as best illustrated by FIG. 11-FIG. 15, the hinged roof portion 28 at the hinge axis X can be configured to be operably slidable within a longitudinal path or guide channel 40 along the side rails 12. The function of this operation is to allow adaptation to varying heights and pitch angles of the rooftop surface 83—allowing the hinged roof portion 28 to rest flush with the rooftop 82 while in the detached, forward position.

Figure 14:
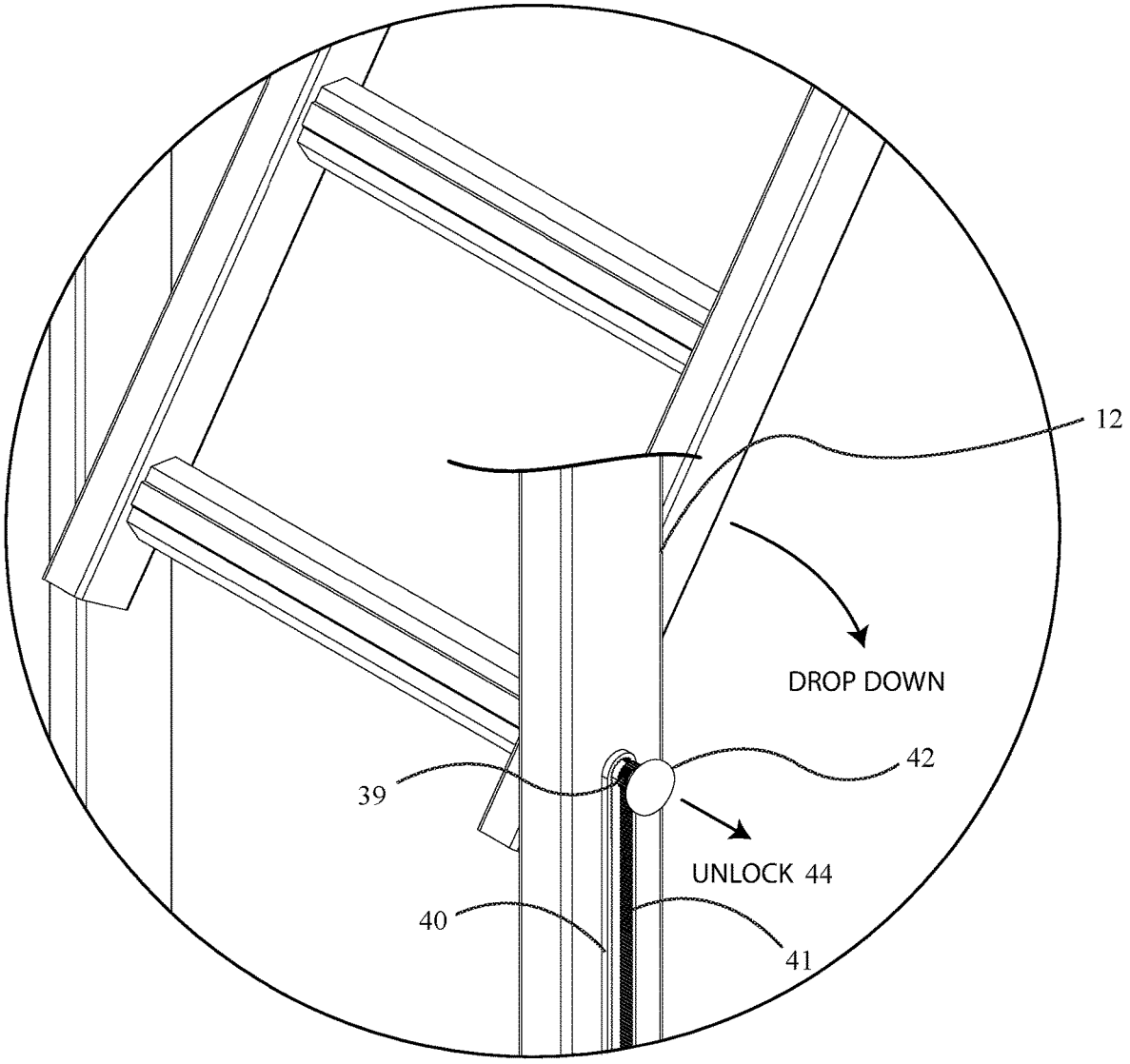
FIG. 14 is an up-close perspective view of the sliding hinge assembly of a version of the invention.
Figure 15:
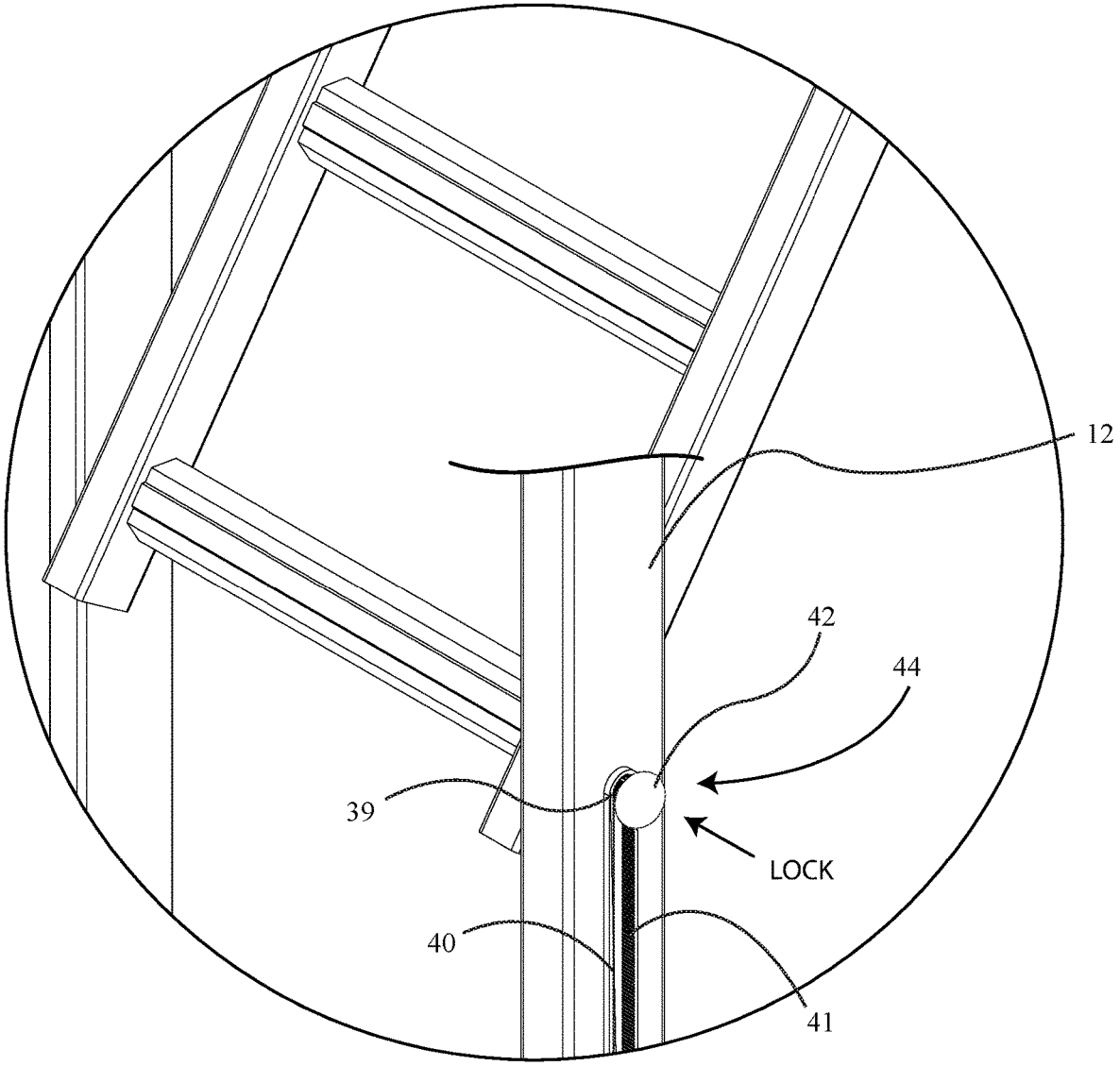
FIG. 15 is an up-close perspective view of the sliding hinge assembly of the version shown in FIG. 14 while in the locked position.

FIG. 14 and FIG. 15 show an up-close view of the slidable configuration utilizing a pin 42 and guide channel 40, wherein the pin 42 slides along the guide channel 40 providing movement of the axis X along the side rails 12. Moreover, a locking means 44 may be provided which locks the axis X at a specified distance along the path of the guide channel 40, providing the user with the ability to adapt the hinged roof portion 28 to a specific height and pitch of the rooftop 82. In the version, the locking means comprises radially aligned teeth 39 about the pin 40 which are operably configured to engage with teeth 41 aligned within the length of the channel 40. Thus, when the pin 42 is depressed inward, the radial teeth 39 statically engage with the teeth 41 aligned in the channel 40.

In the illustrated version, the hinged roof portion 28 comprises opposing side rails 30 connected by a plurality of rungs 32 forming a framed rectangle configuration. As depicted by the illustrated version, the top end 34 may further comprise a horizontally positioned roof stop 36 having a greater width than the safety ladder 10. The roof stop 36 has an exterior surface 38 that is positioned perpendicular to the surface of the adjacent rooftop 82 while the hinged roof portion 28 is extended forward in the detached position. The exterior surface 38 is designed to provide a stopping surface utilized to support objects and persons as they navigate the rooftop 82. In a version of the invention as best illustrated by FIG. 6, the roof stop 36 may be attachably removable with the top end 34 of the hinged roof portion 28.

In the illustrated version, the hinged roof portion 28 further comprises a layer of a padding 29 which is positioned on the exterior surface 38 thereof. While in the detached position, the padding 29 is configured to further grip the rooftop surface 83 and to prevent slippage. The padding 29 can be a foam/rubber padding or other padding known to provide a cushion barrier having gripping qualities. Moreover, near the hinge axis X and channel 40, a hinge barrier 33 may be provided which is positioned to provide a softened barrier between the safety ladder 10 and the edge or eve 86 of the rooftop structure 82, further providing stability to the safety ladder 10 while reducing the chance of damaging the eve 86 or other structure. The hinge barrier 33 can be a padding made of foam rubber similar to the padding 29 material.

Figure 3A:
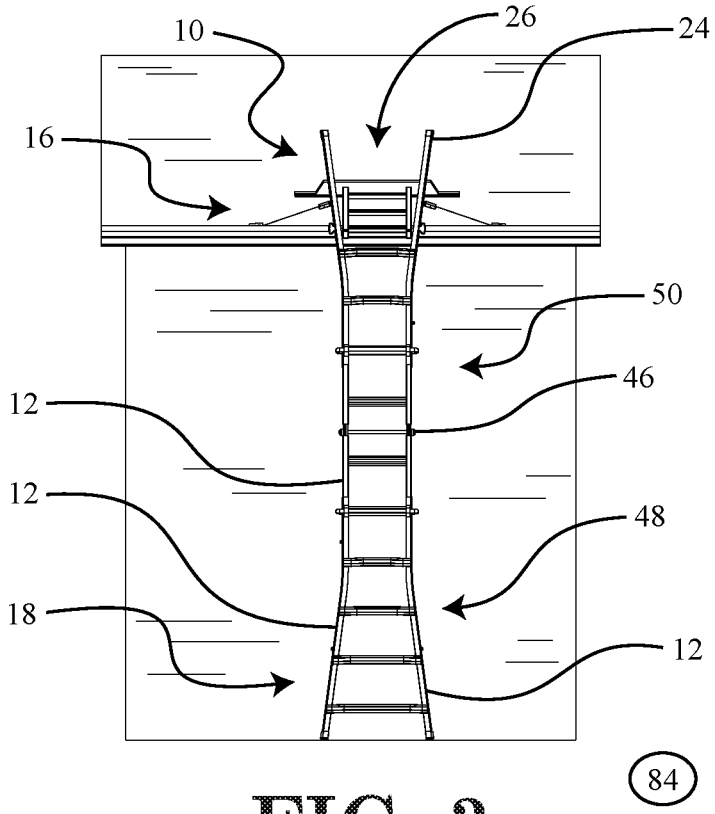
FIG. 3*a* is a front elevation view of the version shown in FIG. 1 shown adapted to a rooftop structure.
Figure 3B:
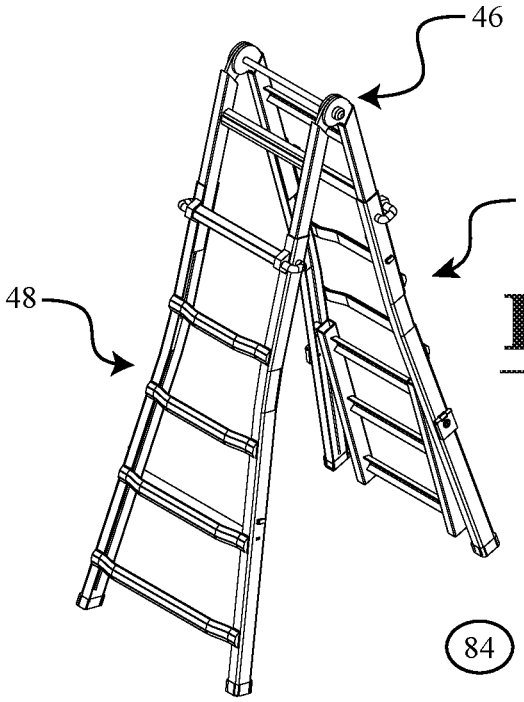
FIG. 3*b* is a perspective view of the version shown in FIG. 1 while in the step ladder configuration.
Figure 4:
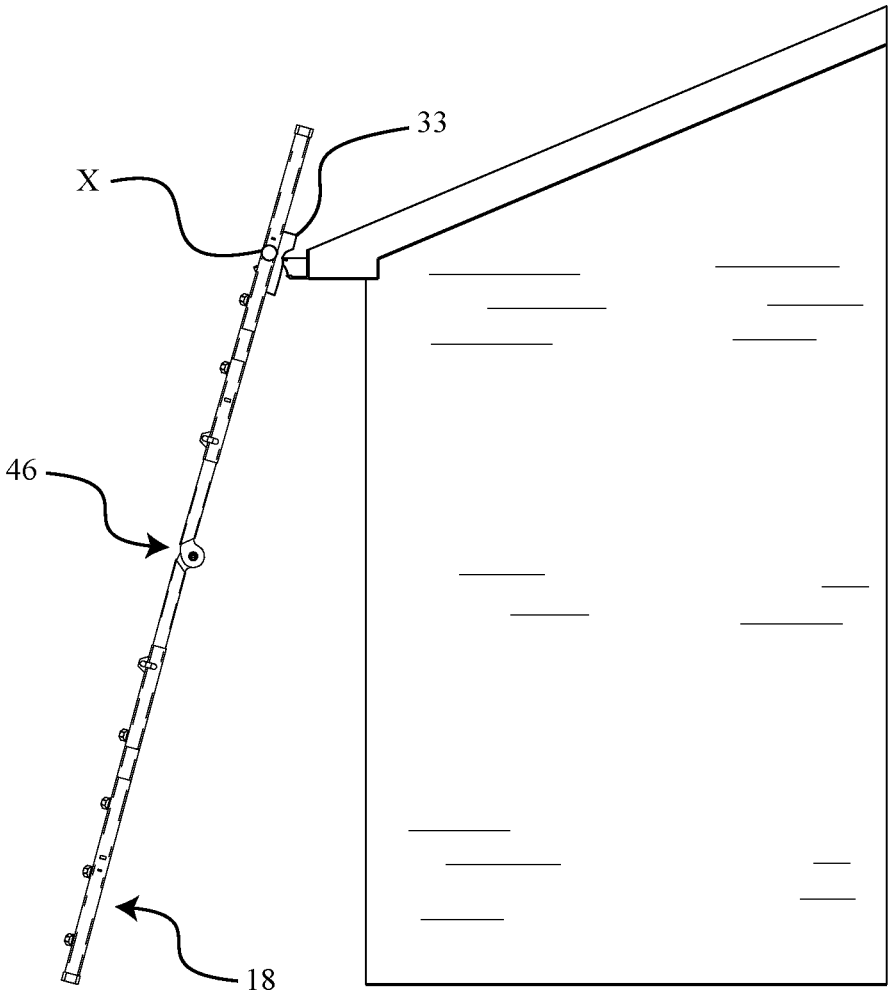
FIG. 4 is a right-side elevation view of the version shown in FIG. 1 shown while the hinged roof portion is in the default position.

In a version of the invention and as best illustrated by FIG. 3*a* and FIG. 3*b*, the safety ladder 10 may further comprise the ability to fold in half into a step ladder configuration. The safety ladder has a hinge 46 located mid-length bisecting the length of the ladder into two parts, a lower half 48 containing rungs and an upper half 50 containing rungs. While in the step ladder configuration, the upper half 50 is folded downward and the upper free end portion 16 provides a second base in conjunction with the lower half 48 and lower free end portion 18 forming an upside down V configuration upon the ground 84.

Figure 1:
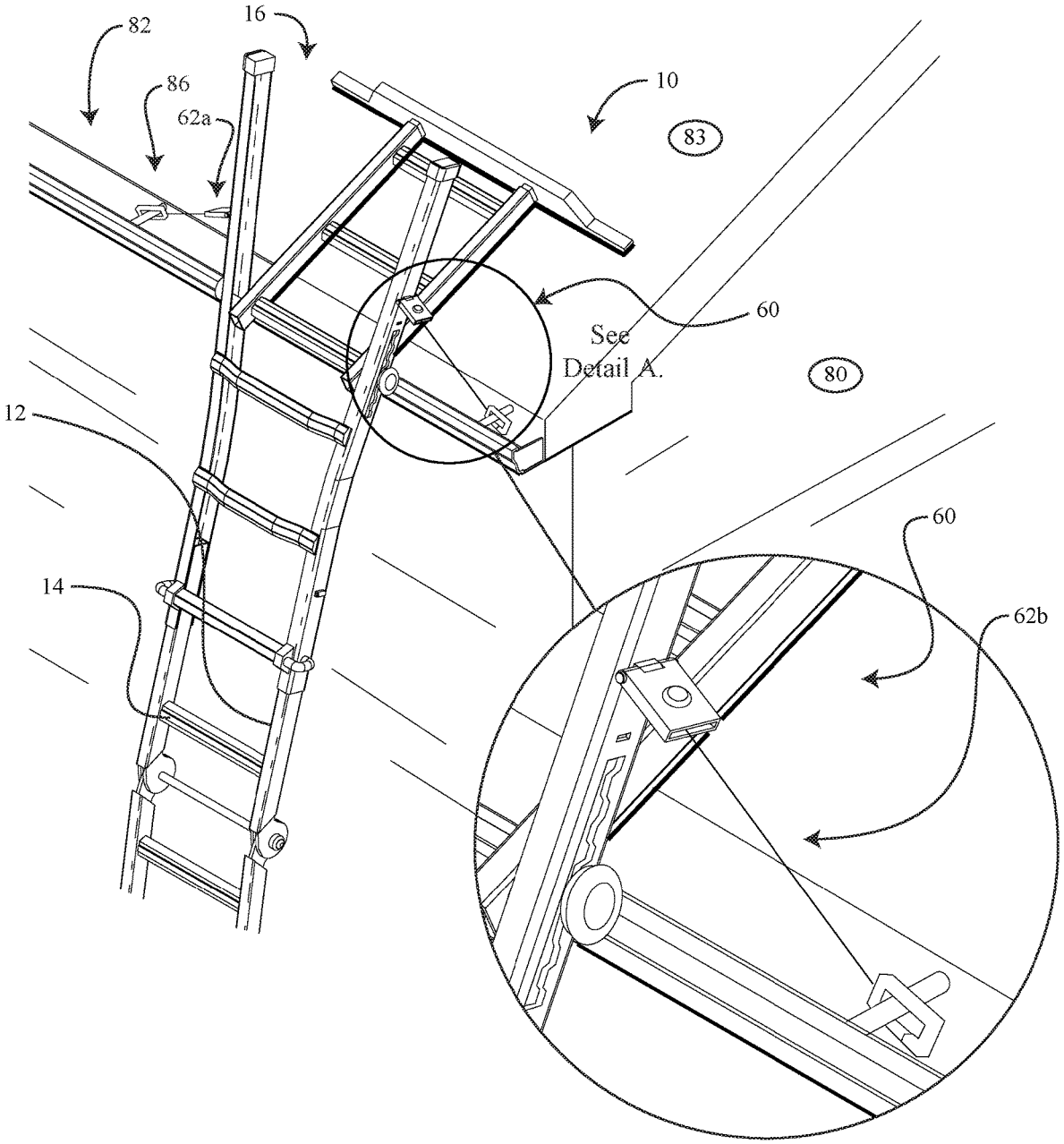
FIG. 1 is perspective view of a version of the application shown as adapted to a rooftop structure.
Figure 2:
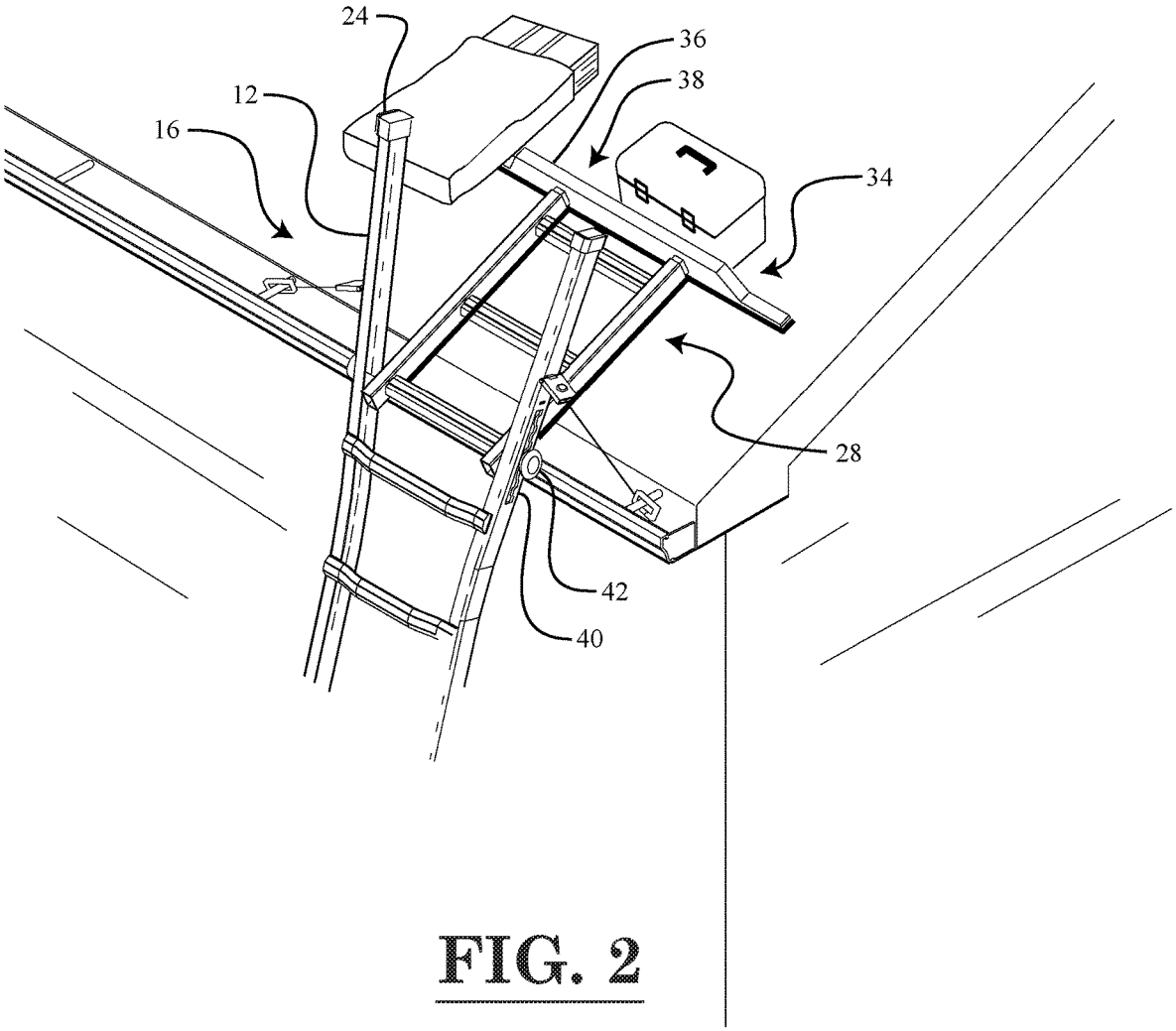
FIG. 2 is an up-close view of the upper free end of the ladder of the version shown in FIG. 1.
Figure 13A:
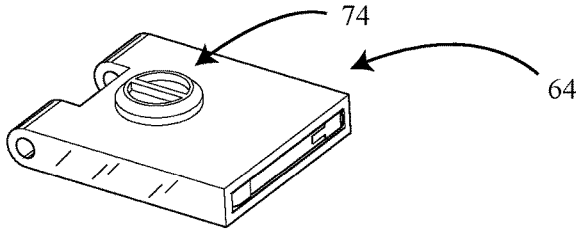
FIG. 13*a* is an up-close perspective view showing a version of the length adjustable tether system while in the retracted position.
Figure 13B:
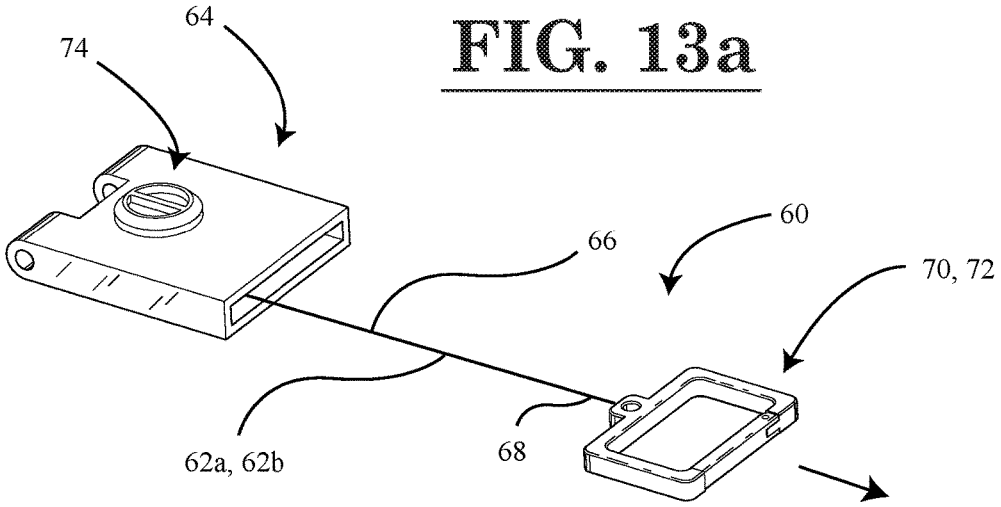
FIG. 13*b* is an up-close perspective view of the length adjustable tether system while in the extended position.
Figure 13C:
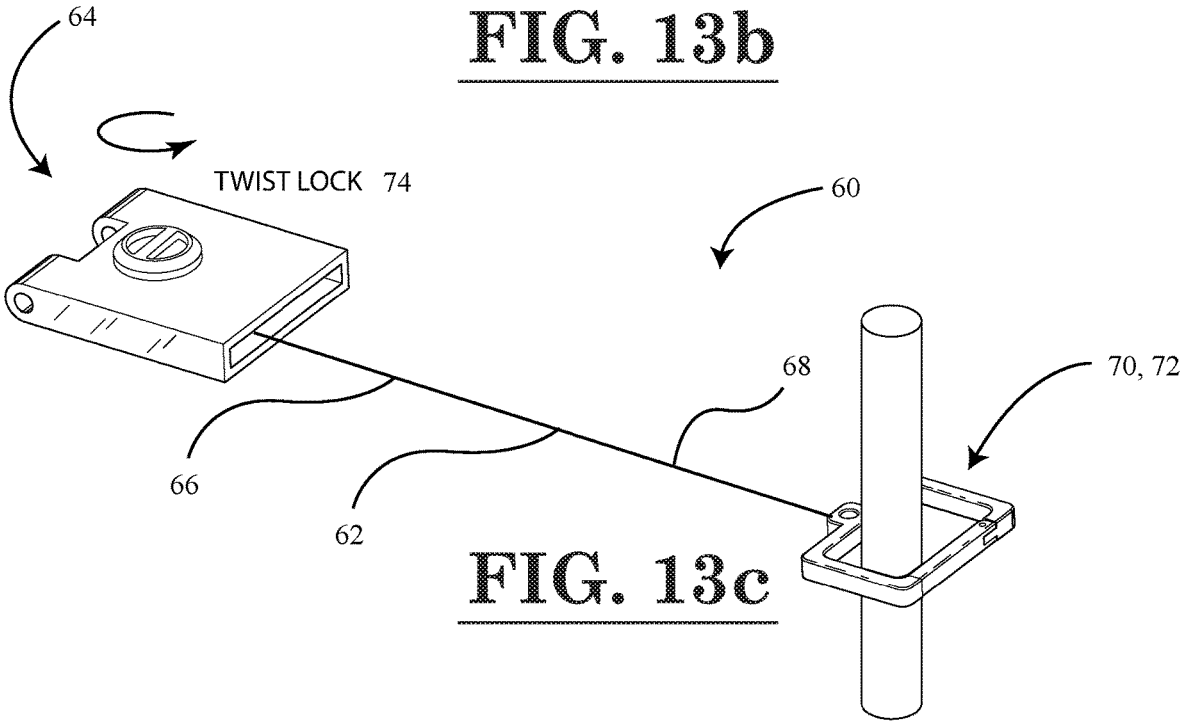
FIG. 13*c* is an up-close perspective view of the length adjustable tether system while in the extended, connected, and locked position.

As best illustrated in FIG. 1, FIG. 2, and FIG. 13, a version of the invention may comprise a length adjustable tether system 60 for connecting the upper free end portion 16 of the safety ladder 10 with the eve 86 of the building structure 80. In the illustrated version, the length adjustable tether system 60 includes a pair of opposing tether lines 62 connecting each side of the ladder side rails 12 to the respective laterally proximal eve 86. The tether lines 62 are connected to the safety ladder 10 at a proximal end 66 by a line retractor 64. The line retractor 64 is an encasement configured to extend and retract the tether line 62 from a reel configuration. Each line retractor 64 is hingedly connected to the outer exposed edge of the side rails 12 which provides a flexible forward and backward tether line 62 rotation of travel.

Moreover, each line retractor 64 includes a means for locking 74 an operably extended length of tether line 62. The means for locking 74 can be any device which locks the desired tether line 62 length by preventing the line retractor 64 from retracting or extending the tether line 62. In the version, the lock 74 is a switch that is turned which seizes the reel into a locked position.

As best illustrated by FIG. 13, at the distal end 68 of each tether line 62 a means for connecting is utilized to connect the tether line 62 to the laterally adjacent eves 86. In the illustrated version and best illustrated by FIG. 1, Detail A, the means for connecting tether the line 62 is a carabiner type clip or metal loop 70 with a spring-loaded gate 72. The metal loop 70 is attached to the eve 86, thereby connecting the safety ladder 10 to the building structure 80 improving lateral stability thereof.

Figure 16:
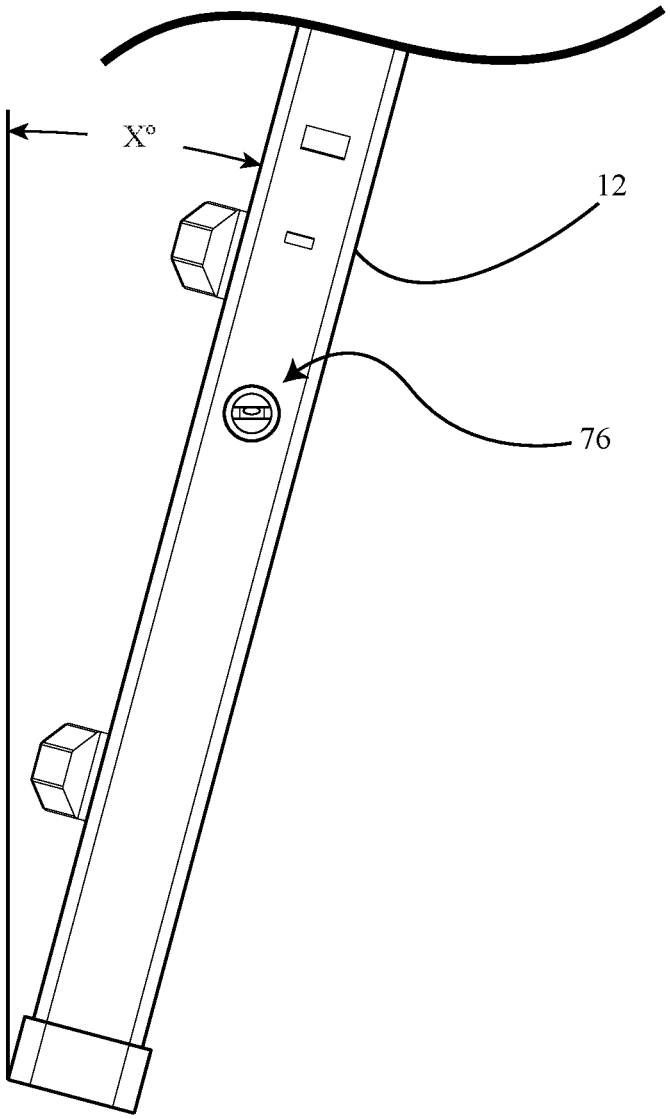
FIG. 16 is an up-close view of a bubble level indicator as required by OSHA in order to ascertain a safe ladder incline X degrees.

Referring to FIG. 16, preferably, the safety ladder 10 may comprise a bubble level indicator 76 for providing guidance to the user regarding proper and safe ladder positioning and tilt angle, which is preferably approximately 75 degrees.

Now referring to all the figures, the operation of the safety ladder system 10 will be described in more detail. Firstly, the safety ladder 10 is unfolded at mid-length at hinge 46. The ladder is locked at the hinge 46 in order to provide a single vertical length of the safety ladder 10. The safety ladder 10 is positioned adjacent to the building structure 80 and the rooftop 82—placing the lower free end portion 18 on the ground and the upper free end portion 16 leaning against the rooftop 82 eve 86. The bubble level 76 is utilized to ascertain a safe angled position and leveling of the rungs 14 at approximately X degrees as shown in FIG. 16.

Once the safety ladder 10 is properly positioned against the building structure 80, the user ascends as is known via the plurality of horizontal rungs 14. Once the user has reached near the upper free end portion 16, the user unlocks the hinged roof portion 28 located between the upward extending side rails 12 by disengaging the pin 42 and rotating forward about the hinge axis X until the hinged roof portion 28 becomes in contact with the rooftop surface 83 in the forward, detached position. It may become apparent that the hinged roof portion 28 does not lay flush with the rooftop surface 83. At this point, the user can adjust the height of the hinged axis X by sliding the hinge axis X upwards or downwards along the guide channel 40. Once the proper angle has been obtained, the user can lock the hinged axis X height into place by the pin 42 and locking 44. Thereafter, if the version further comprises a pair of opposing tether lines 62*a*, 62*b*, the user can extend each line attaching the distal ends 68 to each correlating lateral side via the metal loop 70 with spring loaded gate 72 which provides increased lateral support of the safety ladder 10.

Figure 8:
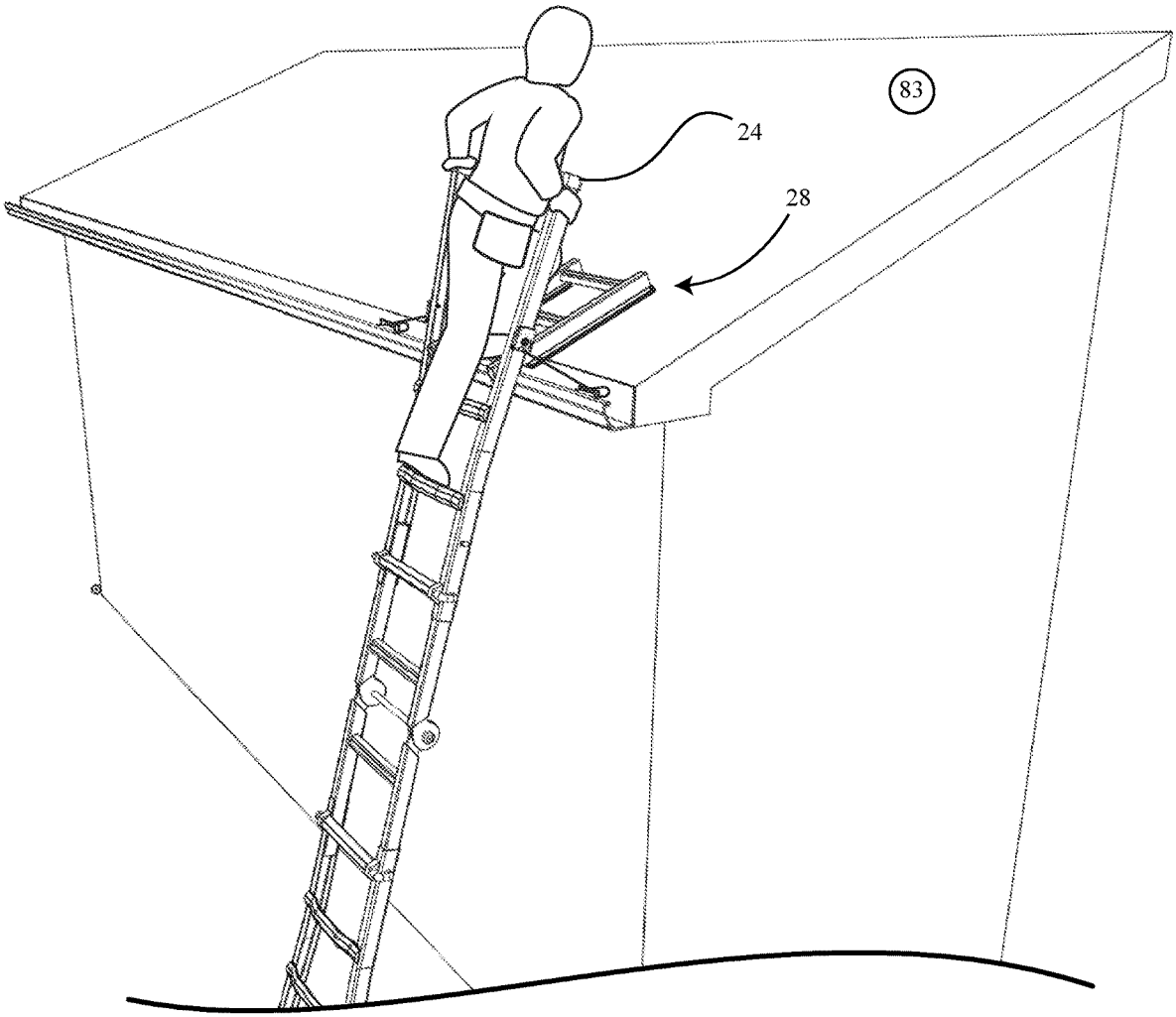
FIG. 8 is an illustrative perspective view of the version shown in FIG. 1.
Figure 9:
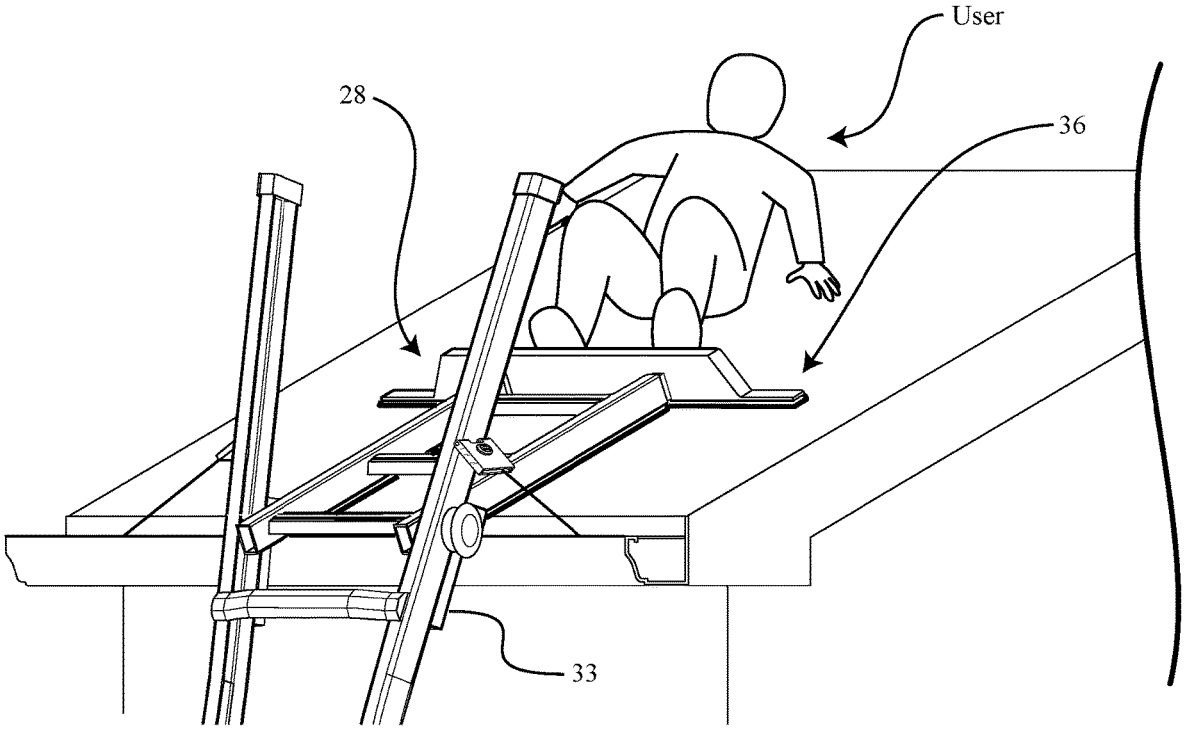
FIG. 9 is an illustrative up-close view showing the hinged roof portion in the detached forward position of the version shown in shown in FIG. 1.
Figure 10:
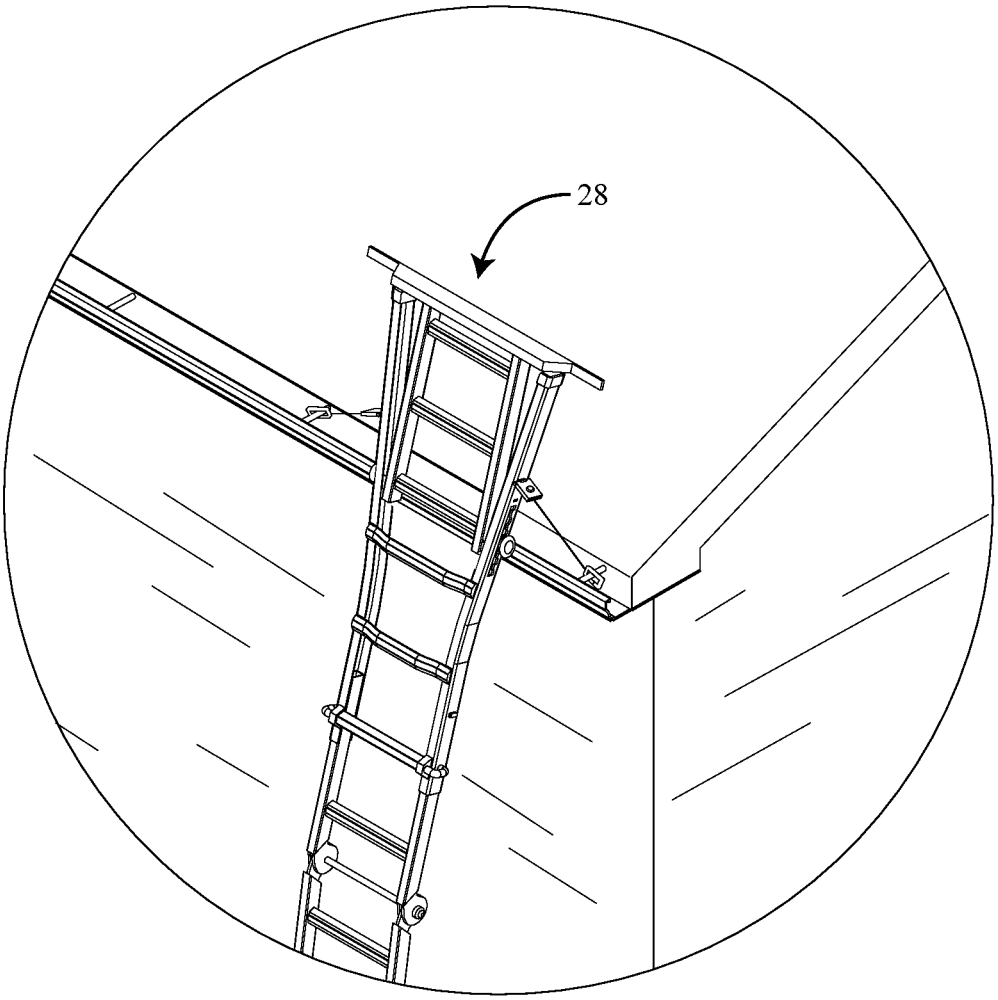
FIG. 10 is an up-close perspective view of an alternative version.
Figure 11:
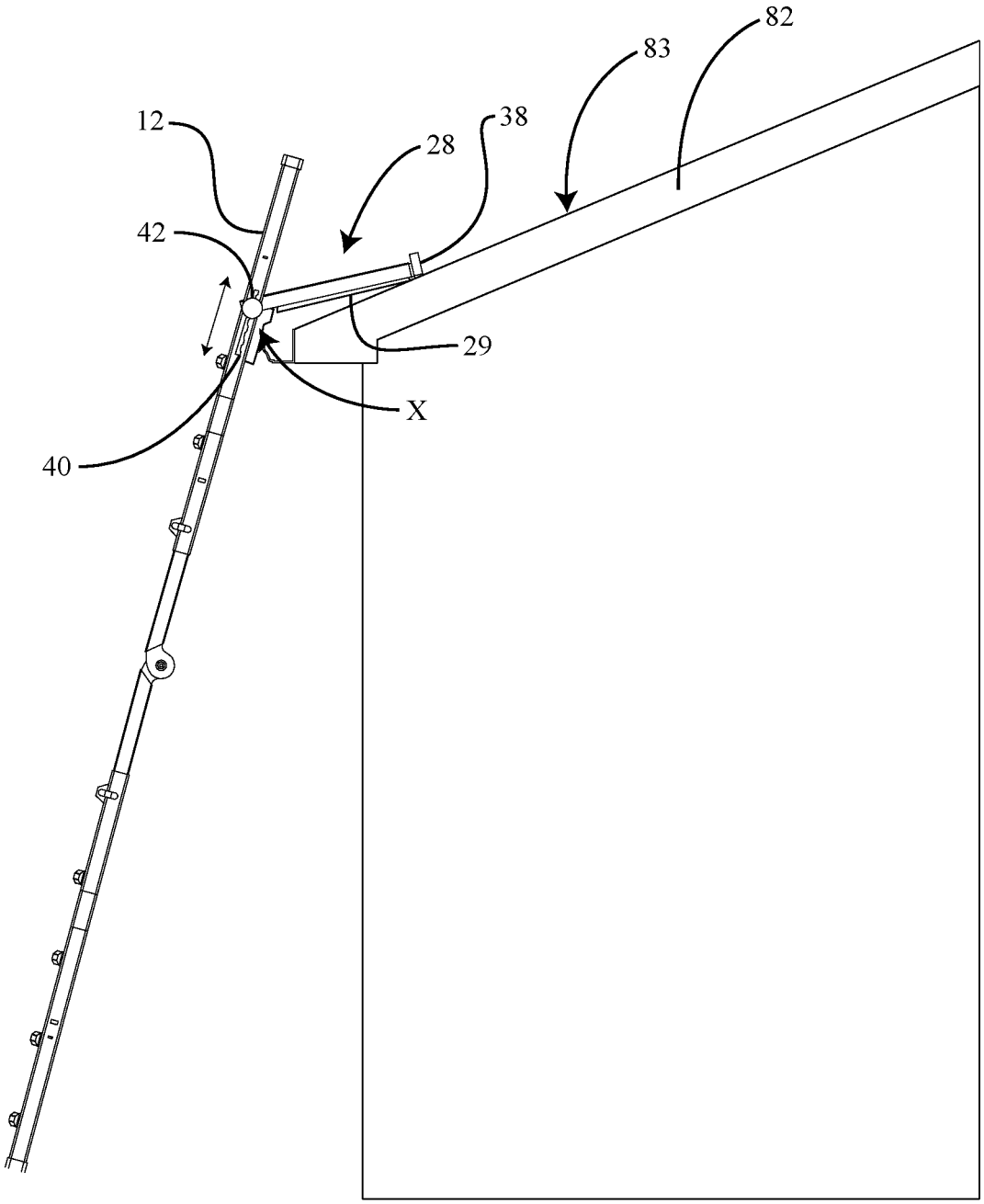
FIG. 11 is a right-side elevation view showing the hinged roof portion in the forward detached position of the version shown in FIG. 10.
Figure 12:
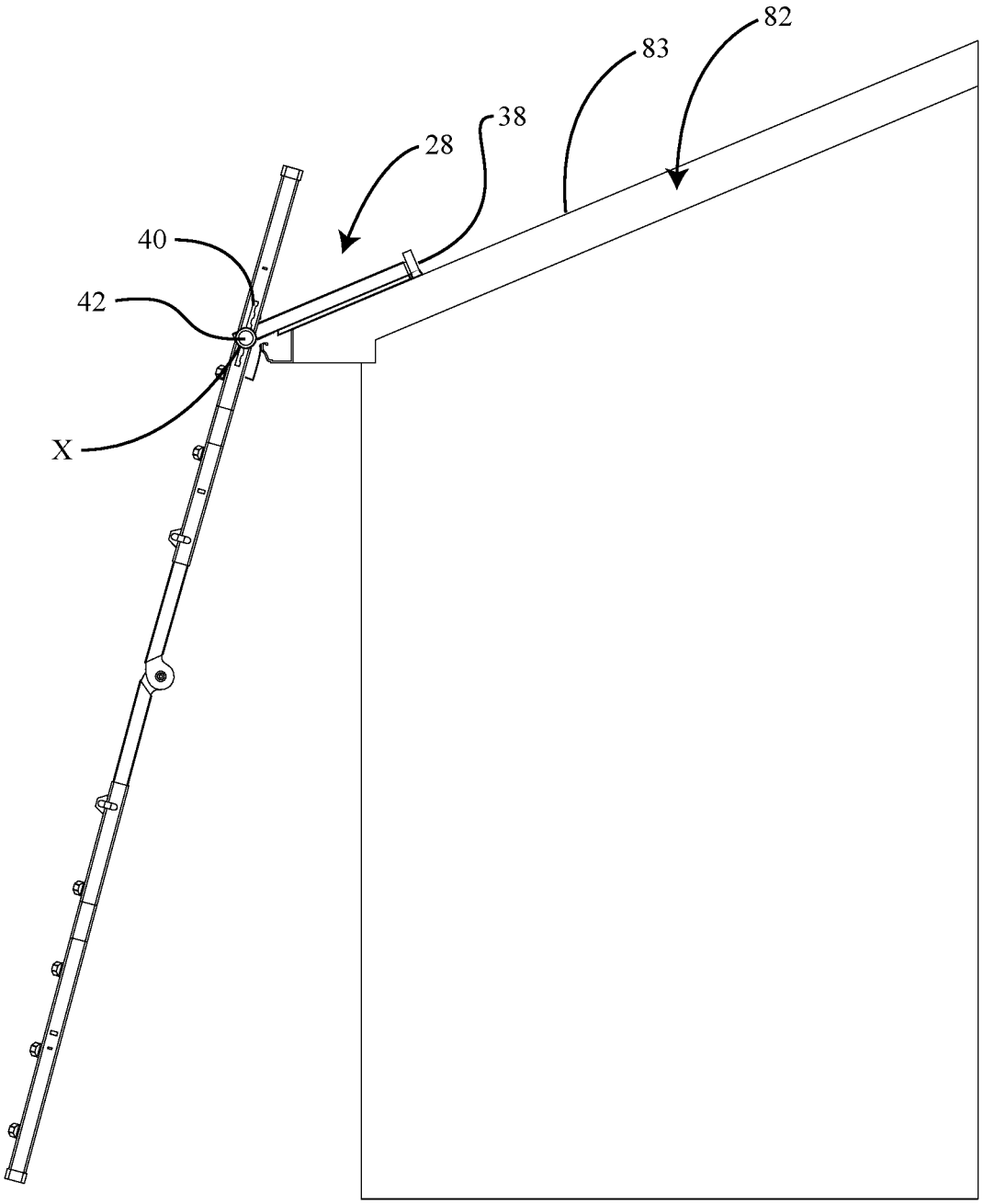
FIG. 12 is a right-side elevation view showing the hinged roof portion in the forward detached position of the version shown in FIG. 10.

Thereafter, the safety ladder 10 is now in the proper position for continuous use. As best illustrated by FIG. 8, the user can ascend the safety ladder 10 with confidence. Once at the top of the safety ladder 10, the user can step through the upward extending rails 12 utilizing the rails 12 and upper end hand supports 24 as support accessing the rooftop surface 83. Moreover, as illustrated by FIG. 2 and FIG. 9, the top end 34 of the hinged roof portion 28 can be utilized to prevent sliding of users and other objects by providing a horizontal roof stop 36 and exterior surface 38 configured substantially perpendicular to the rooftop surface 83.

The safety ladder system 10 can be made in any manner and of any material chosen with sound engineering judgment. Preferably, materials will be strong, lightweight, long lasting, economic, and ergonomic.

The invention does not require that all the advantageous features and all the advantages need to be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A safety ladder system for accessing a rooftop of a building structure, comprising:

a first and second ladder side rail extending between a lower free end and an upper free end, the first and second ladder side rail diverge near the upper free end forming a gap therebetween, each ladder side rail terminating at a hand support end;

a plurality of horizontal rungs vertically disposed between the ladder side rails;

a hinged roof portion operably positioned substantially within the gap while in a default position, the hinged roof portion having parallel roof portion side rails extending between a bottom end and a top end and forming a frame having a plurality of rungs horizontally disposed therein, wherein the hinged roof portion rotates about a hinge axis positioned at the bottom end between the default position and a forward rooftop position;

a horizontal roof stop operably connected to the top end of the hinged roof portion and positioned above the gap while in the default position, the horizontal roof stop having a continuous planar exterior surface that is configured to be substantially perpendicular to the surface of the rooftop while the hinged roof portion is in the forward rooftop position, thereby providing a catch for objects on the rooftop;

wherein the hinge axis is slidable within a longitudinal path along the first and second ladder side rail, a locking means operably configured to lock a position of the hinge axis along the path in order to position the hinged roof portion at an angle which is flush with a pitch of the roof; a padding positioned on an external face the hinged roof portion and the horizontal roof stop, said padding is configured to grip a roof surface to prevent slippage.

2. The safety ladder of claim 1, further comprising opposing first and second length adjustable tethers, each tether comprising:

a line retractor hingedly connected to a respective one of the first and second ladder side rails, the line retractor being an encasement containing a reel;

a line operably connected to the reel, wherein the line retracts and extends on the reel the operable length of the line;

a means of connecting the line end with a nearby object; and a means for locking an operable extended length of line of the length adjustable tether.

3. The safety ladder of claim 2, further providing a step ladder hinge bisecting the length of the ladder into two sections, wherein the safety ladder can be positioned into a step ladder configuration.

4. A safety ladder system for accessing a rooftop of a building structure, comprising: a first and second ladder side rail extending between a lower free end and an upper free end, the first and second ladder side rail diverge near the upper free end forming a gap therebetween, each ladder side rail terminating at a hand support end; a plurality of horizontal rungs vertically disposed between the ladder side rails; a hinged roof portion operably positioned substantially within the gap while in a default position, the hinged roof portion having parallel roof portion side rails extending between a bottom end and a top end and forming a frame having a plurality of rungs horizontally disposed therein, wherein the hinged roof portion rotates about a hinge axis positioned at the bottom end between the default position and a forward rooftop position; a horizontal roof stop operably connected to the top end of the hinged roof portion and positioned above the gap while in the default position, the horizontal roof stop having a continuous planar exterior surface that is configured to be substantially perpendicular to the surface of the rooftop while the hinged roof portion is in the forward rooftop position, thereby providing a catch for objects on the rooftop; wherein the hinge axis is slidable within a longitudinal path along the first and second ladder side rail, a locking means operably configured to lock a position of the hinge axis along the path in order to position the hinged rood portion at an angle which is flush with a pitch of the roof; wherein while the hinged roof portion is in the default position, the top end of the hinged roof portion terminates substantially flush with each hand support end.

* * * * *